US005802617A

United States Patent [19]

Boden

[11] Patent Number: 5,802,617

[45] Date of Patent: Sep. 8, 1998

[54] VENTILATED HEADGEAR

[76] Inventor: Robert O. Boden, 1580 Gaywood Dr., Altadena, Calif. 91001

[21] Appl. No.: 774,032

[22] Filed: Dec. 27, 1996

[51] Int. Cl.[6] ..... A42B 1/22

[52] U.S. Cl. ..... 2/183; 2/175.1; 2/181.2; 2/181.4; 2/182.1; 2/182.2

[58] Field of Search ..... 2/175.1, 181, 181.2, 2/181.4, 182.1, 182.2, 183, 195.2, 418, DIG. 1

[56] References Cited

U.S. PATENT DOCUMENTS

| | | | |
|---|---|---|---|
| D. 266,370 | 10/1982 | Boden . | |
| 1,894,213 | 1/1933 | Ostolaza | 2/182.1 |
| 3,780,382 | 12/1973 | Boden . | |
| 4,101,981 | 7/1978 | Boden . | |
| 4,274,157 | 6/1981 | Boden . | |
| 5,426,789 | 6/1995 | MacLeod | 2/195.2 |

*Primary Examiner*—Diana Biefeld
*Attorney, Agent, or Firm*—Darby & Darby, P.C.

[57] ABSTRACT

A hat or other headgear having a cord, preferably an elongated flexible plastic tube, with a portion extending across the interior of the hat between opposite sides of a lower portion of the crown, at a location to contact the user's forehead and position the hat relative thereto, with the forehead contacting portion of the cord being spaced rearwardly of the lower portion of the crown at the front of the hat to define a front air circulation space through which air can flow upwardly and downwardly between the crown and the cord. At opposite ends of the forehead contacting portion, the cord extends through openings in opposite sides of the hat and then downwardly to form a chin strap. The hat may have an additional air circulation opening, desirably near the rear of the hat, formed by a generally horizontal slit in a generally vertical wall of the hat, with a lower portion of the wall being deformed inwardly beneath the slit.

20 Claims, 2 Drawing Sheets

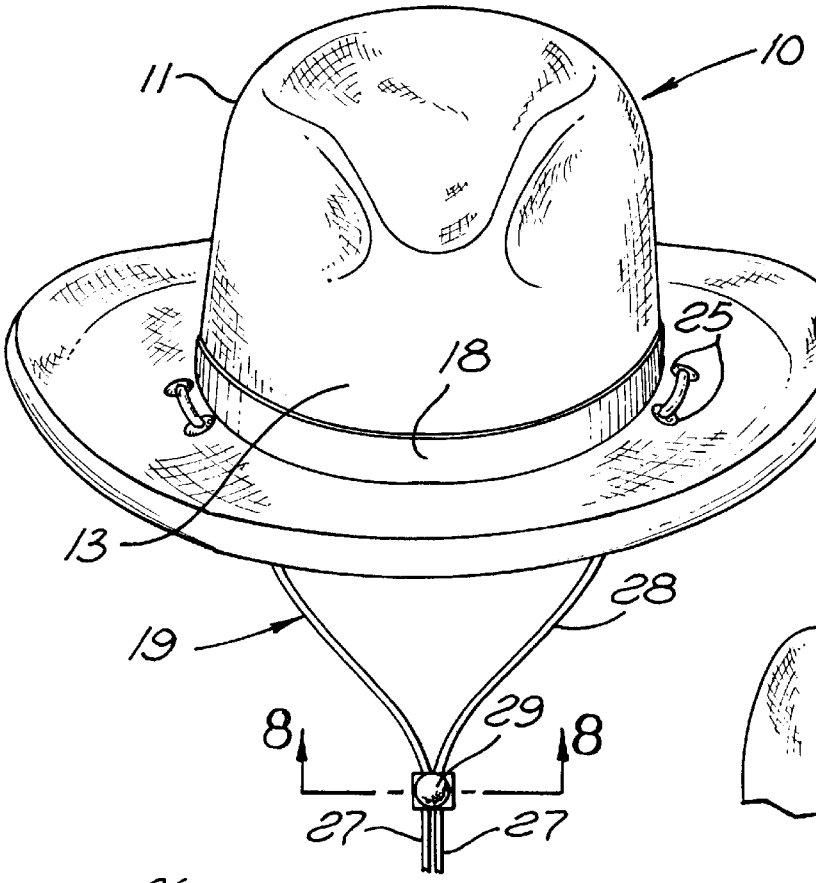
FIG. 1
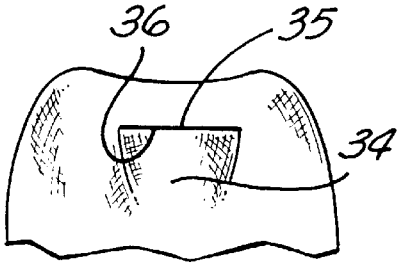
FIG. 7
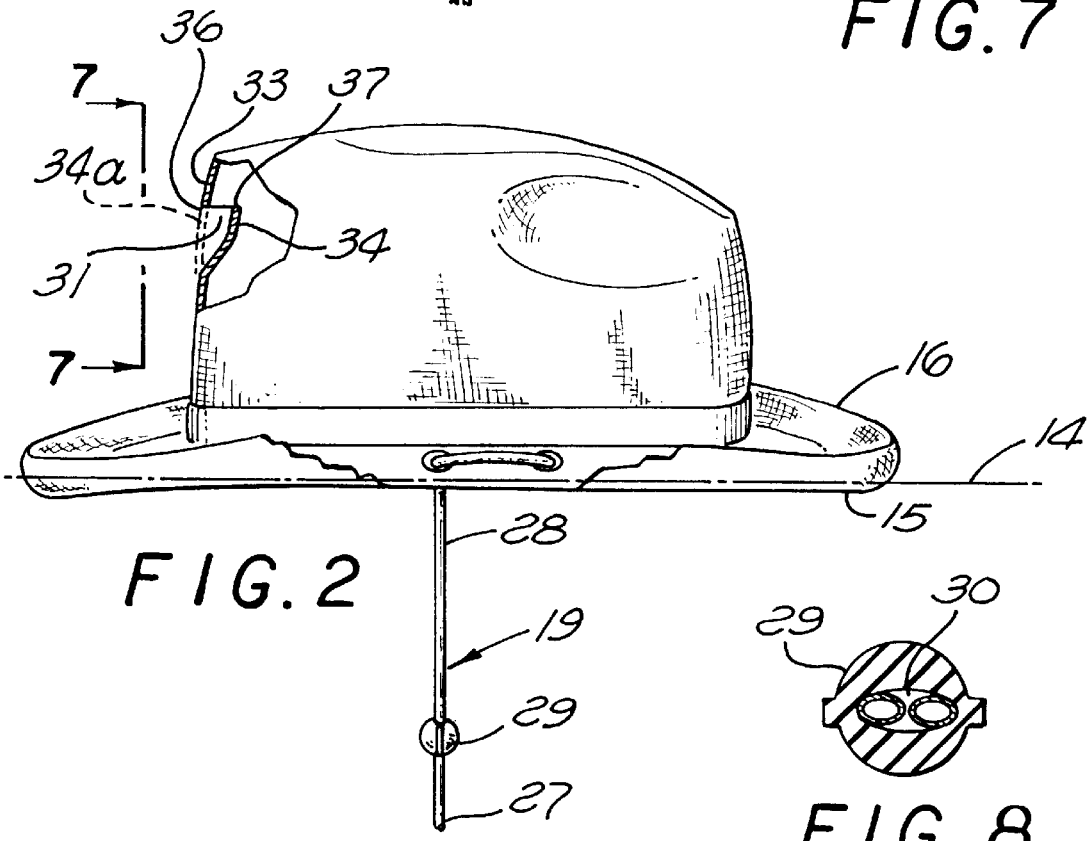
FIG. 2
FIG. 8

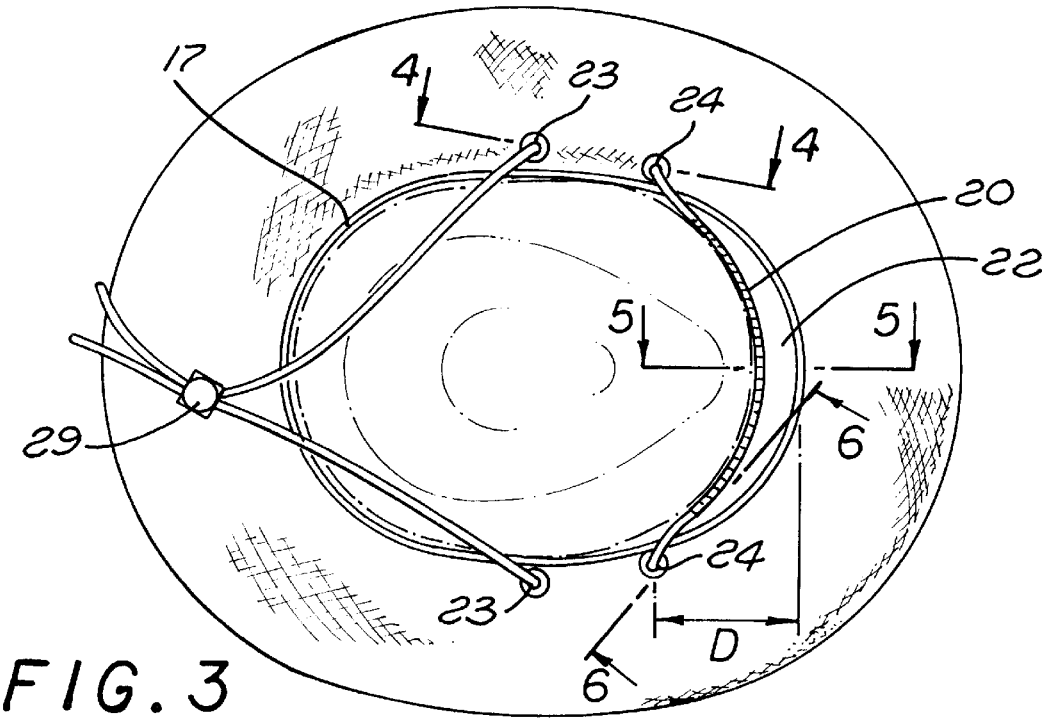
FIG. 3
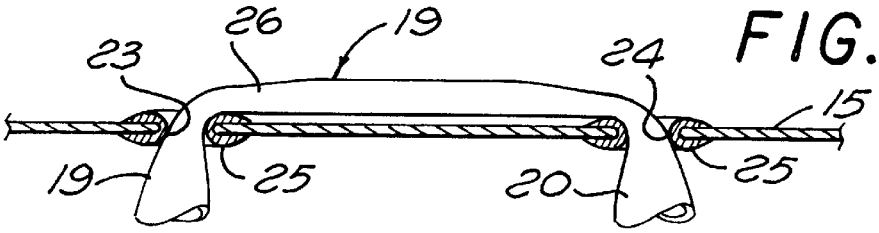
FIG. 4
FIG. 5
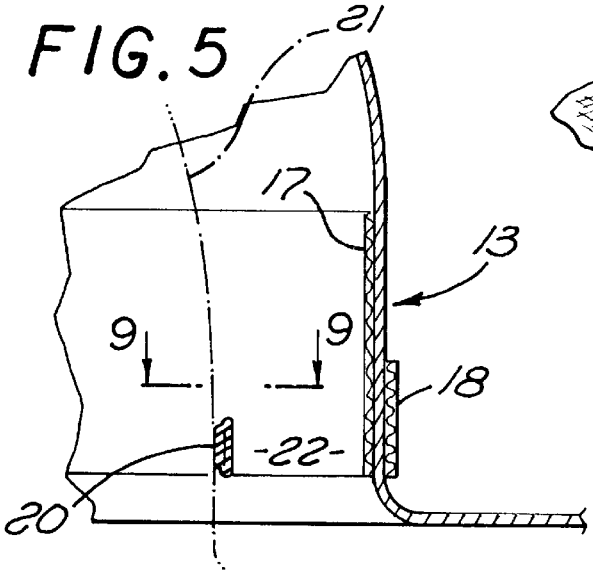
FIG. 6
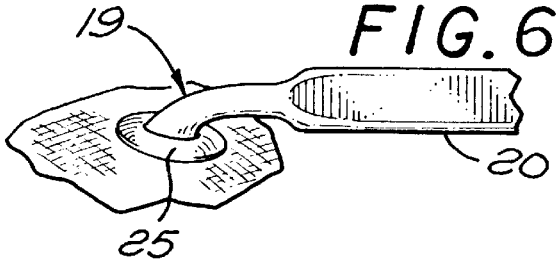
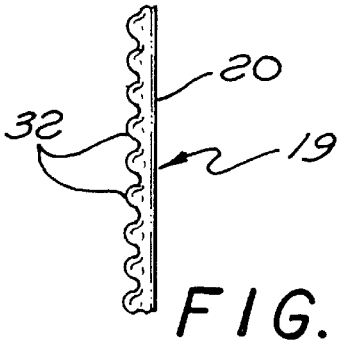
FIG. 9

VENTILATED HEADGEAR

This invention relates to improved headgear of a type adapted to permit the circulation of air between the interior and exterior of a crown portion of the headgear, to cool the head of a user. The invention will be described primarily as applied to the construction of a brimmed hat, but it will be apparent that the invention can also be utilized in caps or other types of head coverings. The term "hat" as utilized in the claims is intended to be interpreted generically as including such caps and other types of head covers with which the invention might be compatible.

BACKGROUND OF THE INVENTION

Various expedients have been proposed in the past for permitting the circulation of air between the interior and exterior of a hat or other head cover to prevent overheating within the hat. For example, some hats currently on the market are formed of straw or other fiber woven very loosely in a manner leaving small air circulation spaces between the different fibers of the weave to permit a flow of air between the interior and exterior of the crown of the hat. Unfortunately, the rays of the sun can also enter the hat through those openings and strike the user's head within the hat. Other proposals have included provision of variously positioned and formed openings in otherwise imperforate crown material, sometimes in combination with additional panels or elements positioned to block the sun's rays but permit the flow of air on a somewhat circuitous path to the interior of the hat. It has also been proposed to provide spacers or means for holding the lower portion of the crown of the hat away from contact with the user's head, to allow the circulation of air upwardly and downwardly at that location. Most of these prior arrangements with which I am familiar have entailed sufficient complexity and cost to prevent any wide scale acceptance by the public.

SUMMARY OF THE INVENTION

The major purpose of the present invention is to provide an improved type of hat or other head cover which can completely block off the rays of the sun from access to the interior of the hat, but which will at the same time allow a relatively free circulation of air between the interior and exterior of the hat, and which can accomplish these results with a structure much simpler and less expensive than the previously proposed arrangements. A hat embodying the features of the invention can in fact be produced for very little more than a conventional hat not having those features.

To provide for the circulation of air upwardly and downwardly in front of the forehead of a user, a hat embodying the invention includes a flexible cord, preferably in the form of an elongated flexible plastic tube, having a portion which extends across the interior of the hat between opposite sides of a lower portion of the crown at a location to contact the user's forehead and define a front air circulation space through which air can flow upwardly and downwardly between the crown and the cord. At a side of the hat, the cord extends through an opening or openings in the hat in a relation enabling longitudinal adjustment of the cord to vary the effective size of the hat. Preferably, the cord extends through two openings at each of the opposite sides of the hat, and then extends downwardly to form a chin strap for retaining the hat on a user's head. A cord lock or other device may be shiftable longitudinally of the lower ends of the cords to vary the length and tightness of the chin strap. Also, the portion of the cord which contacts the user's forehead is preferably flattened to enlarge the area of contact and increase the comfort with which the hat is worn.

Another feature of the invention relates to the provision of a unique type of opening in a portion of the crown of the hat, preferably at the back of the hat, with that opening being configured to allow air circulation at that point but prevent access of the sun's rays through the opening to the interior of the hat. For this purpose, the opening is formed as a generally horizontal slit in a generally vertical wall of the hat, with a lower portion of that wall beneath the slit being deformed inwardly relative to an upper portion of the wall above the slit. Air may then circulate vertically through the slit and behind the upper portion of the wall, with that portion of the wall effectively blocking the path of any solar rays into the hat. The term 'slit' as utilized in the specification and claims of this application is intended to be interpreted generically as including any opening which will function in essentially the manner of the slit disclosed in the application.

BRIEF DESCRIPTION OF THE DRAWINGS

The above and other features and objects of the invention will be better understood from the following detailed description of the typical embodiment illustrated in the accompanying drawings, in which:

FIG. 1 is a front elevational view of a hat formed in accordance with the present invention;

FIG. 2 is a side view of the hat, partially broken away;

FIG. 3 is a bottom plan view of the hat;

FIG. 4 is an enlarged fragmentary vertical section taken on line 4—4 of FIG. 3;

FIG. 5 is an enlarged fragmentary vertical section taken on line 5—5 of FIG. 3;

FIG. 6 is a fragmentary view taken on line 6—6 of FIG. 3;

FIG. 7 is a fragmentary rear elevational view taken on line 7—7 of FIG. 2;

FIG. 8 is an enlarged horizontal section through the cord lock, taken on line 8—8 of FIG. 1; and FIG. 9 is an enlarged fragmentary plan view of a portion of the tubular cord of the device taken on line 9—9 of FIG. 5.

DESCRIPTION OF THE PREFERRED EMBODIMENT

Referring first to FIG. 1, there is illustrated at 10 a hat which is of an essentially conventional shape but which has been provided with the ventilation features of this invention. Hat 10 may be formed of any conventional material, such as woven straw, woven plastic fibers, or the like. The material of the hat may have sufficient stiffness to normally retain the illustrated shape. The body of the hat is formed to have an upper crown portion 11 which extends across the top of the user's head and downwardly at the sides, front and back of the head to a lower portion 13 of the crown which encircles the user's head. The crown may typically be considered as terminating downwardly in a horizontal plane 14 (FIG. 2), with the brim 15 of the hat extending outwardly in all directions generally in that plane to an outer upturned peripheral edge portion 16 of the brim. An inner hat band 17 may be stitched or otherwise secured to the inner face of the lower portion 13 of the crown, and an outer band 18 may extend about the outside of the lower portion 13.

To provide an air circulation space within the forward portion of the hat, and to provide a chin strap for the hat, an elongated cord 19 is carried by the hat in the relationship illustrated in the drawings. This cord 19 is flexible and is preferably formed of longitudinally resiliently stretchable resinous plastic tubing, for best results composed of a relatively soft elastic polyvinylchloride. Cord 19 has a portion 20 which extends across the front of and contacts the user's forehead (represented at 21 in FIG. 5), and which is spaced rearwardly of the lower portion 13 of the crown and its carried inner band 17 at the front of the hat, to define an air circulation space 22 (FIGS. 3 and 5) through which air may flow upwardly and downwardly between portion 20 of the cord and the lower portion of the crown.

At the opposite ends of its forehead contacting portion, cord 19 is attached to the hat by extension through openings formed at opposite sides of the hat, desirably in inner portions of the brim 15 as seen in FIGS. 3 and 4. There are preferably two such openings 23 and 24 at each side of the hat, with each opening containing a circular eyelet 25 defining the edge of the opening and through which the tubular cord 19 extends in fairly closely fitting relation. At each end of the forehead contacting portion 20, the tubing forming cord 19 extends upwardly through a forward one of the openings 24, then rearwardly at 26 to the second opening 23 at which the cord extends downwardly to a lower end 27. The downwardly extending portions 28 of the cord pass through a shiftable cord lock 29 which grips the cords and is slidable upwardly and downwardly therealong to form the cords into a chin strap adapted to be tightened to any desired condition about the chin of a wearer. The cord lock device 29 may be of a type shown and described in my U.S. Pat. No. 5,440,788 issued Aug. 15, 1995. As shown in that patent, the device 29 may be a simple essentially spherical rubber body having an elongated opening 30 through which the cords extend and within which the cords are normally gripped fairly tightly by the resilience of the rubber. The grip on the cords can be released by squeezing the rubber element 29 to enlarge the width of elongated opening 30, and permit the locking device 29 to be slid upwardly and downwardly to any desired setting.

As seen in FIG. 3, the forward openings 24 through which cord 19 extends at opposite ends of the forehead contacting portion 20 of the cord are offset a substantial distance D rearwardly of the forwardmost portion of the lower extremity 13 of the crown and its carried inner band 17, so that when the portion 20 of the cord is tightened to extend directly across the interior of the hat between the two openings 24, portion 20 is located considerably behind the opposed portion of band 17 to allow for the previously discussed air circulation space 22. The user's head will normally be large enough to bow portion 20 of the cord forwardly beyond openings 24 as seen in FIG. 3, but still leave the air circulation space 22. For persons with larger heads, the portion 20 is bowed an increased amount, thus providing an adjustment in the effective size of the hat but still in all instances leaving the air circulation space 22 in front of the user's forehead. The friction attained between eyelets 25 in openings 23 and 24 and the cord as it extends upwardly through forward openings 24 and then rearwardly and downwardly through openings 23 is sufficient to frictionally retain the cord in any set position relative to the openings at the opposite sides of the hat, and thus retain portion 20 in any set condition to fit a particular user's head. This friction may be overcome by forcibly pulling the cord in either direction through the openings at the two sides of the hat to adjust portion 20 to fit the forehead of a different person.

At the location of portion 20 of cord 19, the initially tubular material of that cord is flattened to the condition illustrated in FIG. 5. The tubing is retained in that flattened condition by ultrasonically welding opposite side portions of the tubing together. This flattened transverse sectional shape is essentially the same across substantially the entire length of portion 20 from one of the side openings 24 to the same opening 24 at the opposite side of the hat. Preferably the rear generally vertical face of the essentially flattened portion of the cord has slight irregularities 32, (FIG. 9) which engage the user's forehead and help prevent perspiration from forming and damming up at this location. These irregularities may take the form of closely spaced shallow vertical ribs as shown. Except at the location of flattened part 20 of cord 19, that cord has a circular tubular shape.

In addition to the air circulation space at the front of the hat, crown 11 is also provided with an additional air circulation opening 31, preferably at the back of the hat, to facilitate the flow of air into the front of the hat and out through its rear opening 31, or vice versa. This rear opening is provided in extremely simple manner by first shaping the rear wall 33 of the crown to extend substantially directly vertically, then forming a horizontal slit in that vertical wall, and then deforming a portion of the vertical wall beneath the slit from the condition represented in broken lines at 34*a* to the full line condition 34 of FIG. 2. The location of the horizontal slit is represented at 35 in FIG. 7. When the lower portion of the rear vertical wall of the crown is deformed to the condition represented at 34 in FIG. 2, this leaves a first horizontal edge 36 of the slit as a lower edge of upper portion 33 of the vertical wall, and leaves the second edge of the slit as an upper horizontal edge 37 of lower portion 34 of the wall. As seen in FIG. 2, edge 37 is spaced horizontally inwardly from edge 36, leaving the opening 31 at the slit as a passage through which air may flow upwardly or downwardly between the interior and exterior of the crown. The upper portion 33 of the vertical wall of the crown effectively blocks entry of any sun rays into the crown through opening 31.

In using the hat, a person places the hat on his or her head with the portion 20 of cord 19 contacting the user's forehead in the manner discussed, to provide the air circulation space 22 in front of the forehead. The cord is adjusted within openings 23 and 24 at opposite sides of the hat to vary the length of the portion 20 to fit the particular user's head size. Thereafter, the cord will remain in that set position to always fit that particular user, but may if desired be subsequently adjusted to fit a different person's head. When it is desired to tighten the chin strap against the chin of a user to retain the hat on his head under windy conditions, the user slides cord lock 29 upwardly against the chin.

While a certain specific embodiment of the present invention has been disclosed as typical, the invention is not limited to this particular form, but rather is applicable broadly to all such variations as fall within the scope of the appended claims.

I claim:

1. Ventilated headgear comprising:

a hat having a crown adapted to extend across the top of a user's head and downwardly thereabout to a lower portion of the crown for encircling the user's head, said hat including a front portion and a rear portion and defining an interior portion;

an elongated flexible element having a forehead contacting portion extending across the interior of the hat between opposite sides of said lower portion of the crown at a location to contact a user's forehead and position the hat relative thereto;

said forehead contacting portion of said elongated element being spaced rearwardly of said lower portion of the crown at the front of the hat to define a front air circulation space through which air can flow; and said elongated element having portions at opposite ends of said forehead contacting portion which extend through openings in opposite sides of the hat and then downwardly to form together a chin strap.

2. The ventilated headgear as recited in claim 1, in which said elongated element is frictionally retainable by said openings against longitudinal movement within the openings to retain said forehead contacting portion of the elongated element at a desired length.

3. The ventilated headgear as recited in claim 1, in which said hat has a brim within which said openings are formed.

4. The ventilated headgear as recited in claim 1, in which said hat has two of said openings through which said elongated element extends at each side of the hat.

5. The ventilated headgear as recited in claim 1, in which said hat has a brim within which said openings are formed, there being two of said openings in the brim at each of said opposite sides of the hat, each of said portions at opposite ends of the forehead contacting portion extending upwardly through a first of the openings and then downwardly through a second of the openings, and then forming the chin strap.

6. The ventilated headgear as recited in claim 5, in which said elongated element is frictionally retained against longitudinal movement within said openings and is adjustable relative thereto to vary the length of said forehead contacting portion of the elongated element.

7. The ventilated headgear as recited in claim 6, in which said elongated element is formed of flexible resinous plastic tubing which is essentially circular in cross section except at said forehead contacting portion whereat the cross section thereof is retained in flattened condition, and further including a unit retaining opposite ends of said elongated element together and which is adjustable along said ends of the element to vary the size of said chin strap.

8. The ventilated headgear as recited in claim 7, in which said crown has a generally vertical wall containing a generally horizontal slit between upper and lower portions of the wall with edges defining the slit, said lower portion of the wall and said edge thereof being deformed inwardly relative to said upper portion of the wall and said edge thereof, so that air can flow through the slit.

9. The ventilated headgear as recited in claim 1, in which said elongated element is a flexible tube which is flattened at said forehead contacting portion thereof to increase the area of contact with a user's forehead.

10. The ventilated headgear as recited in claim 1, in which said elongated element is formed of flexible resinous plastic tubing which is essentially circular in cross section except at said forehead contacting portion whereat the cross section thereof is retained in flattened condition.

11. The ventilated headgear as recited in claim 1, including means securing opposite ends of said elongated element together at said chin strap.

12. The ventilated headgear as recited in claim 1, including a unit retaining opposite ends of said elongated element together and which is adjustable along said ends of the element to vary the size of said chin strap.

13. The ventilated headgear as recited in claim 1, in which said crown has an opening near the rear of the hat through which air may pass.

14. The ventilated headgear as recited in claim 1, in which said crown has a generally vertical wall containing a generally horizontal slit between upper and lower portions of the wall with edges defining the slit, said lower portion of the wall and said edge thereof being deformed inwardly relative to said upper portion of the wall and said edge thereof, so that air can flow through the slit.

15. The ventilated headgear as recited in claim 14, in which said slit is formed in the rear of said hat.

16. The ventilated headgear as recited in claim 1, in which said crown has an opening near the rear of the hat through which air may pass.

17. Ventilated headgear comprising:

a hat having a crown adapted to extend across the top of a user's head and downwardly thereabout to a lower portion of the crown for encircling the user's head, the hat including a front portion, a rear portion, and a side portion including a pair of spaced apart openings, and defining an interior of the hat;

an elongated, flexible element including a forehead contacting portion extending across the interior of the hat between opposite sides of said lower portion of the crown at a location to contact a user's forehead and position the hat relative thereto;

said forehead contacting portion of said elongated element being spaced rearwardly of said lower portion of the crown at the front of the hat to define a front air circulation space through which air can flow upwardly and downwardly between the crown and the elongated element; and said elongated element having a portion at an end of said forehead contacting portion which extends through said first and second openings and is adjustable longitudinally within said openings to vary the length of the forehead contacting portion and is frictionally retained against longitudinal movement by the openings.

18. Ventilated headgear comprising:

a hat having a crown adapted to extend across the top of a user's head and downwardly thereabout to a lower portion of the crown for encircling the user's head, the hat including a front portion, a rear portion, and a pair of opposite side portions, each side portion having formed therein at least one opening, said crown defining an interior of the hat;

an elongated, flexible element including a forehead contacting portion extending across the interior of the hat between opposite sides of said lower portion of the crown at a location to contact a user's forehead and position the hat relative thereto;

said forehead contacting portion of said elongated element being spaced rearwardly of said lower portion of the crown at the front of the hat to define a front air circulation space through which air can flow between the crown and the elongated element; and said elongated element having portions at opposite ends of said forehead contacting portion which extend through the respective openings in the opposite side portions, are adjustable within said openings to vary the length of the forehead contacting portion, and are frictionally retained against movement relative to the openings.

19. The ventilated headgear as recited in claim 18, in which said elongated element is a flexible tube which is flattened at said forehead contacting portion thereof to increase the area of contact with a user's forehead.

20. The ventilated headgear as recited in claim 18, including a unit retaining opposite ends of said elongated element together and which is adjustable along said ends of the element.

* * * * *